United States Patent [19]

Simko

[11] 4,197,059

[45] Apr. 8, 1980

[54] FUEL INJECTION PUMP HAVING MEANS FOR RETARDING THE FUEL INJECTION TIMING SCHEDULE

[75] Inventor: Aladar O. Simko, Dearborn Heights, Mich.

[73] Assignee: Ford Motor Company, Dearborn, Mich.

[21] Appl. No.: 928,212

[22] Filed: Jul. 26, 1978

[51] Int. Cl.[2] ..... F04B 49/00; F02M 59/24; F02M 59/36

[52] U.S. Cl. ..... 417/282; 417/294; 417/292; 123/140 MC; 123/179 L

[58] Field of Search ..... 417/269, 270, 282, 289, 417/294; 123/139 AW, 140 MC, 179 G, 179 L

[56] References Cited

U.S. PATENT DOCUMENTS

| | | | |
|---|---|---|---|
| 3,635,603 | 1/1972 | Eheim | 417/282 |
| 3,640,259 | 2/1972 | Garcia | 123/179 L |
| 3,777,730 | 12/1973 | Gates | 123/179 L |

*Primary Examiner*—William L. Freeh
*Attorney, Agent, or Firm*—Robert E. McCollum; Clifford L. Sadler

[57] ABSTRACT

FIGS. 1 and 1*a* show a fuel injection pump assembly having an axially and rotatably mounted fuel metering sleeve valve 60 rotated by an engine driven pumping member 34 whereby the valve helix 68 selectively covers and uncovers a fuel spill hole 74 leading to a fuel delivery valve 82, the pump having a centrifugal injection timing advance mechanism 108, 110, 112 connecting the pumping member 34 and the metering valve by a pin and slot type connection permitting an angular rotation of the metering valve relative to the pumping member to advance the position of the helix 68 relative to the spill port 74 per revolution of the pumping member, and other means 170, 172, 95 operable at will to retard the fuel injection timing schedule regardless of the position of the injection timing advance mechanism.

15 Claims, 6 Drawing Figures

FUEL INJECTION PUMP HAVING MEANS FOR RETARDING THE FUEL INJECTION TIMING SCHEDULE

This invention relates in general to a fuel injection pump. More particularly, it relates to one having a centrifugal fuel injection timing advance mechanism.

Date from tests conducted on fully warmed up engines utilizing fuel injection equipment consistently indicate that hydrocarbon emissions are lowered when the injection timings are retarded during the start up and warm up of a cold engine.

During starting, the cold combustion chamber walls and the cooler combustion air temperatures due to heat loss to the walls during compression increase the hydrocarbon emissions. The cold combustion chamber walls cause a larger hydrocarbon quench layer, and the cooler combustion air temperatures are less favorable for hydrocarbon oxidation in the lean midair quench zones.

After starting and during the warm up period, an engine equipped with a centrifugal fuel injection timing advance mechanism generally advances the timing as a function of speed increase. This increases the time between the end of injection and the start of combustion, which reduces the amount of fuel air stratification due to the increased mixing time. As this occurs, hydrocarbon emissions increase again due to increased wall quenching and the lean midair quenching of the combustion process, thereby resulting in more unburned mixture or hydrocarbons in the chamber.

Retarding of the fuel injection timing during starting and warm up of a cold engine, therefore, will reduce unburned hydrocarbon emissions.

Therefore, it is a primary object of this invention to provide a fuel injection pump assembly that not only includes a centrifugal fuel injection timing advance mechanism but also means for retarding the fuel injection timing schedule during engine starting and warmup of a cold engine to reduce hydrocarbon emissions.

Fuel injection pump controls are known in which the fuel injection timing is retarded automatically during the starting of the engine. For example, U.S. Pat. No. 3,726,608, Fuel Injection Pump Timing Device, Bostwick et al, shows and describes such a device with reference to FIGS. 8 and 9. It consists of a spring moved sleeve that is splined to a pump drive member for automatically positioning the pump in a retarded timing position for starting purposes. However, it is not possible to selectively retard the timing at any point in the schedule of fuel injection, and the timing is retarded irrespective of whether the engine is fully warmed up or operating cold. U.S. Pat. No. 3,138,112, Porta et al, shows and describes a fuel injection pump assembly having a pair of centrifugal weights 28 for rotating a metering sleeve to change the fuel injection timing. Column 4, lines 25 to 30 refers to a multi-grooved cam slot for controlling the injection advance. However, no description of retarded timing schedule is provided. U.S. Pat. No. 3,648,673 shows a fuel injection pump assembly construction similar to that of the invention; however, no retard of the timing schedule is provided.

In summary, none of the known fuel injection pump assemblies have an injection advance timing schedule that is modified at will to retard the schedule for a desired period of time and at any point in the timing schedule, to control hydrocarbon emissions.

Other objects, features and advantages of the invention will become more apparent upon reference to the succeeding detailed description thereof, and to the drawings illustrating the preferred embodiment thereof; wherein, FIG. 1 is a cross-sectional view of a fuel injection pump assembly constructed according to the invention;

FIG. 1*a* is an extension of FIG. 1 illustrating the cold retarded timing feature;

Figure 1:
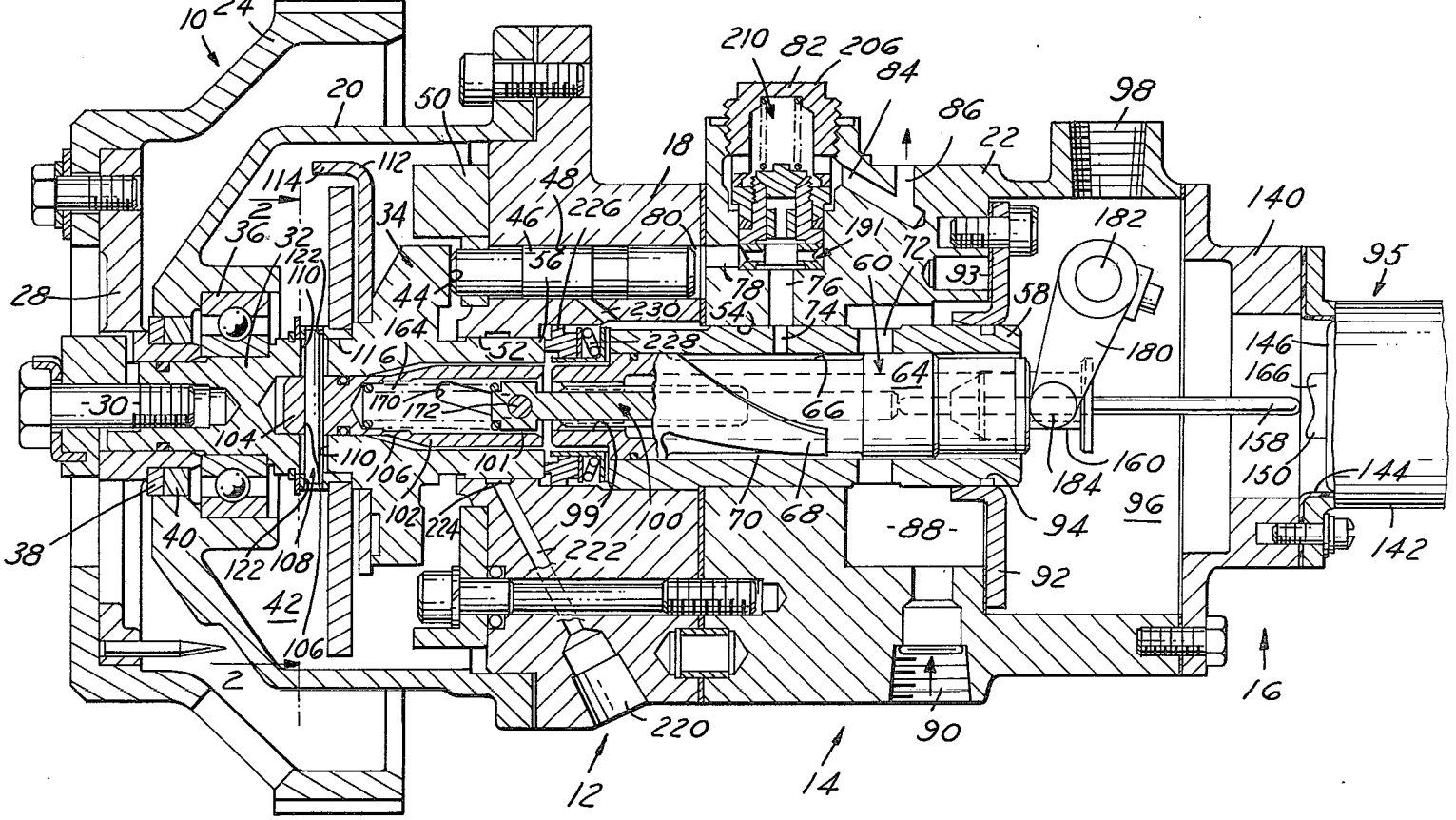

FIG. 1 shows a fuel injection pump assembly having a combination drive and injection timing advance section 10, an oil or lubricant supply section 12, a fuel delivery section 14, and a cold start timing retard section 16. More specifically, the assembly includes a three part stationary housing consisting of a main body 18, a timing advance housing 20 and a fuel delivery valve housing 22, all bolted together as shown. The timing advance section 10 includes a drive pulley 24 in this case adapted to be belt driven from the cam shaft of an internal combustion engine, not shown. Pulley 24 is bolted, as shown, to a drive coupling assembly 28 that is attached by a bolt 30 to the cam shaft end 32 of a fuel pumping member 34. End 32 is rotatably mounted within the shell-like timing advance housing 20 by means of ball bearings 36. A felt-washer 38 and oil seal 40 prevent the leakage of lubricant from the space 42 defined within shell 20 to which oil is admitted in a manner to be described later.

The pumping member 34 is formed with a cam face 44 specifically contoured in the manner shown and described in my patent, U.S. Pat. No. 3,856,438, to control the displacement of a number of pump plungers 46 with which it is engaged. The contour of the cam face is such as to match fuel flow characteristics with engine air flow characteristics throughout the entire speed and load range of the engine. The cam face 44 engages a number of equally spaced, circumferentially arranged pump plungers 46 axially slidably mounted in separate bores 48 in the main housing body portion 18. A plunger guide plate or disc 50 is mounted against housing portion 18. It has a number of fingers, not shown, against which are located flats on the plungers to guide the plunger movement while at the same time permit a slight oscillatory movement. Plungers 46 are progressively moved axially by the cam face 44 as pumping member 34 rotates. As will become clear later, the plungers 46 are returned to their position against the cam face by the pressure of fuel against the opposite ends.

The main housing body portion 18 and delivery valve housing portion 22 have a central stepped diameter bore 52, 54. The pumping member 34 is provided with a sleeve drive extension 56 that extends into the bore 52, the inner periphery of the main body housing portion 18 constituting a journal bearing surface at this point. Fixed within bore 54 of the delivery valve housing portion 22 is a stationary sleeve 58. Slidably and rotatably mounted within the sleeve 58 is a fuel metering sleeve valve 60 of the spool type. The sleeve valve 60 has a pair of spaced lands 62 and 64 interconnected by a neck portion 66 of reduced diameter. The lefthand (as seen in FIG. 1) land 62 is formed in the shape of a helix 68 whereas land 64 is of conventional construction. The helix or outer cam face portion 68 together with the contiguous reduced diameter cam face portion defined by the neck 66 and the inner periphery of the sleeve 58 define a fuel annulus 70. The latter cooperates with a fuel inlet passage 72 provided in sleeve 58 and a number of fuel spill ports or passages 74 corresponding in number to the number of fuel pump plungers 46.

Each of the spill ports 74 is connected by a passage 76 to a plunger discharge passage 78 connected to a cavity 80 defined between the end of each plunger 46 and the bore 48 in which it is mounted. In this interconnection between passages is mounted a fuel delivery valve 82 of the retraction type, to be described later. In brief, the spring closed retraction delivery valve 82 is set to open at a predetermined fuel pressure acting thereagainst to deliver fuel through a pair of connecting passages 84 and 86 to a fuel injection nozzle, not shown, for injection of fuel directly into the engine cylinder with which it is associated. The retraction valve is moved when the helix 68 of the metering sleeve valve covers or blocks the spill port 74. This effects an increase in pressure in lines 78 and 76 when the pump plunger 46 moves rightwardly as seen in FIG. 1 to its maximum position to a point where the pressure exceeds the opening pressure of the retraction valve. As the helix 68 continues to rotate, spill port 74 will be uncovered to open the spill port to the fuel annulus 70 and permit spillage of fuel from the passages 78 and 76. This decreases the injection pressure to a level below that of the opening pressure of the retraction valve, at which point it will be seated and injection will be terminated.

The fuel inlet port or passage 72 is supplied with fuel from a chamber 88 connected to a fuel inlet passage 90 that is adapted to be connected to any suitable source of fuel under pressure, not shown. The stationary sleeve 58 and the fuel inlet chamber is sealed against leakage by a sump cover 92 that is bolted to the delivery valve housing portion 22 as shown, with a gasket 93 and O-ring seal 94 between. The cover 92 together with the cold start retard mechanism 95 to be described define a sump 96 into which excess fuel flows for exit through an outlet 98 back to the inlet of the supply pump.

The sleeve valve 60 is drive connected to the pumping member 34 in a manner to permit both axial and angular rotation of the sleeve valve relative to the pumping member. More specifically, the metering sleeve valve is internally splined by straight splines 99 to a coupling member or shaft 100 that extends leftwardly as seen in FIG. 1 for a pinned connection to be described later to a sleeve extension 102 of a drive coupling timing retard cam 104. The coupling 104 is provided with a diametrically located throughhole 106 in which is press fitted a drive pin 108. The pin also extends through a pair of diametrically opposite drive slots 110 in the pump cam shaft 32, shown more clearly in FIG. 2. Each of the slots 110 extends circumferentially as indicated to permit a limited angular relative rotation between the drive pin and pumping member 34. It will be clear that this limited action will permit an angular indexing of the metering sleeve valve relative to the pumping member to permit advancing of the timing of the fuel injection from an initial position by changing the phase of the helix 68 with respect to each of the spill ports during one revolution of the pumping member 34. This action occurs automatically above a predetermined speed level by a centrifugal flyweight type advance mechanism enclosed by the timing advance housing 20.

Figure 2:
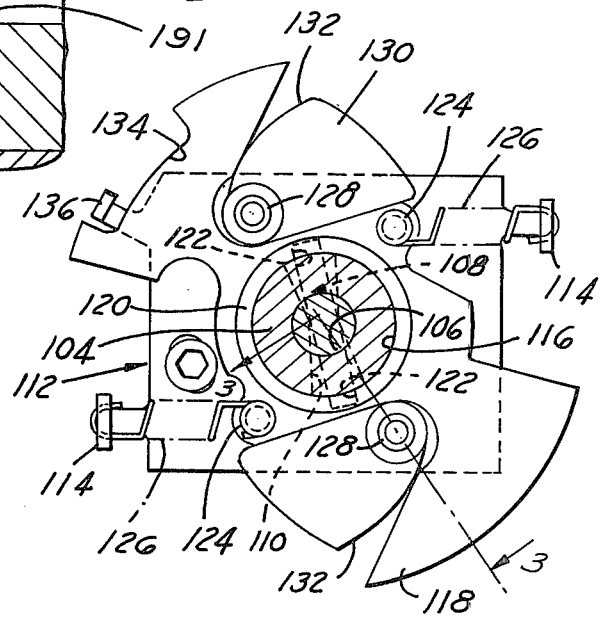
FIG. 2 is a cross-sectional view taken on a plane indicated by and viewed in the direction of the arrows 2—2 of FIG. 1 and illustrating a centrifugal fuel injection timing advance mechanism.
Figure 3:
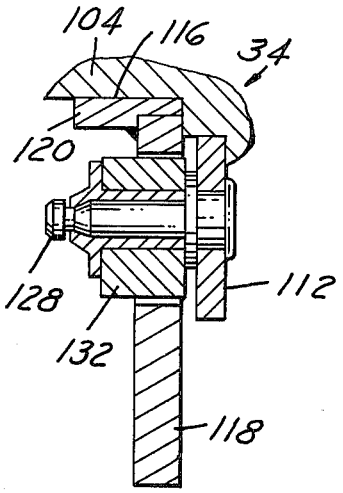
FIG. 3 is a cross-sectional view taken on a plane indicated by and viewed in the direction of the arrows 3—3 of FIG. 2; and, FIGS. 4 and 5 are enlarged views of details of FIG. 1.

As best seen in FIGS. 2 and 3, fixed to the pumping member 34 is a timing advance plate 112 having a pair of upturned portions 114 that serve as spring anchors. Rotatably mounted on a stepped portion 116 of the hub of pumping member 134 is a cam plate 118 having a hub 120 with diametrically opposite radial holes or apertures 122. The drive pin 108 shown in FIG. 1 is inserted through the hole 106 in coupling 104, through the slots 110 in the shaft of pumping member 34, and through the holes 122 in the hub 120 to form a driving connection between the metering sleeve valve 60, the drive means 100, the sleeve extension or coupling 104, the pumping member 34, and the cam plate 118.

The cam plate 118 is formed with a pair of spring retention pins 124 each of which anchor one end of a spring 126, the other end of which is hooked over the anchor 114. The cam plate 118 carries a pair of centrifugal weight pivots 128 on which are rotatably mounted centrifugally responsive weights 130 having cam surfaces 132. Once the preload of springs 126 is overcome, further increases in speed of the base plate 112 of pumping member 34 causes a counter-clockwise rotation of the weights 130 by centrifugal force to move the cam plate 118 and drive pin 108 in the same direction. The drive pin 108 will rotate in slots 110 relative to pumping member 34 to slowly and progressively advance the fuel injection timing for each revolution of the pumping member 34. Cam plate 118 is provided with a slot or cutout 134 for cooperation with a stop member 136 formed on the drive plate 112 to limit the fuel injection timing advance movement.

Figure 1A:
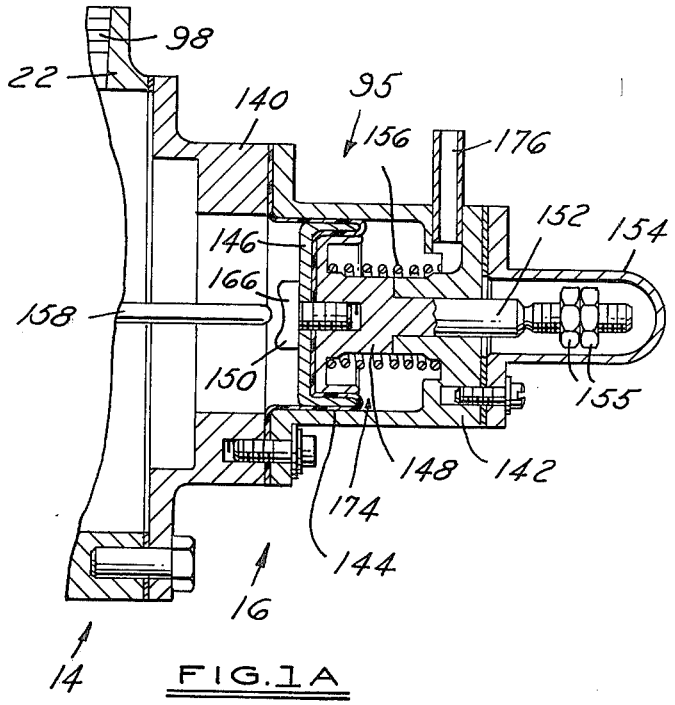

The pump assembly is provided with a cold start retard timing setting device 94 shown at the right hand of FIG. 1 and fully in FIG. 1*a*. Data from tests on engines of the type with which the fuel injection pump assembly of this invention could be used indicates that hydrocarbon emissions are lower when the injection timings are retarded from their normal settings for an engine that is to be started when cold. The device 94 automatically retards the fuel injection timing for the start and warm up of a cold engine.

More specifically, the sump 96 is covered by a tubular boss or housing 140 to which is bolted a hat-shaped servo housing 142. Between the two is edge mounted an annular flexible diaphragm member 144. The diaphragm is centrally apertured and secured between a pair of retainers 146 and 148 by a bolt 150. The retainer 148 has a stem portion 152 projecting through the housing 142 into the interior of a cover member 154. A pair of adjusting nuts 155 is threaded on the end of stem 152 and serves to limit the leftward movement, as seen in FIG. 1*a*, of the diaphragm 144 by abutment against the housing 142.

The diaphragm 144 is normally biased leftwardly by a spring 156 to abut the bolt 150 against the end of an actuating rod 158. As seen in FIG. 1, rod 158 projects through a yoke connector 160 formed on the end of metering sleeve valve 60, and continues through the open center of the valve into engagement with the end of the drive shaft 100. A spring 164 biases the drive shaft or coupling 100 against the rod 158 and, in turn, the rod 158 against the button-like seat 166 on the bolt 150.

Sleeve extension 102 contains an angled slot 170 (FIGS. 1 and 5) that receives a drive pin 172 that projects laterally from the end of drive shaft 100 and drive connects the pumping member 34 and metering valve 60 through the extension 102. Movement of the rod 158 and drive coupling 100 leftwardly, as seen in FIG. 1, under the influence of servo 95, spring 156 will cause an angular rotation of the sleeve extension 102 and drive pin 106 in pump shaft slots 110 to move the cam plate 118 in a clockwise or reverse direction from whatever position it has been set, to a retarded timing setting, as desired for a cold start or warm up of the engine. That is, assume the angular rotation caused by servo 95 resets the timing 30° below whatever the setting was prior to movement by servo 95. The centrifugal weight advance mechanism then resumes from that point. As the pump speed increases, the centrifugal mechanism will advance the timing in the normal way, but so long as the retard servo operates, the timing will always be retarded 30° from its normal setting.

The cold start retard servo 94 is deactivated when vacuum is applied to the servo chamber 174 through a tube 176 from any suitable source such as engine intake manifold vacuum. The supply of vacuum to tube 176 could be manually controlled but preferably would be controlled by a temperature sensitive valve that would supply vacuum to tube 176 only after a certain engine temperature operating level had been reached. Subsequently, vacuum applied through tube 176 to chamber 174 will draw the diaphragm 144 rightwardly and permit spring 164 in the sleeve extension 104 to move the drive shaft 100 and rod 158 rightwardly as seen in FIG. 1. This will cause a reverse rotation of the sleeve extension 104 and drive pin 106 and cam plate 118 to return the injection timing 30°, for example, to its normal setting.

The metering sleeve valve 60 is movable axially at will to vary fuel flow rate by a manually operated lever 180. The lever has a pivot 182 and an actuating end 184 universally connected to a yoke end 160 of the metering valve. The pivot 182 would be connected by any suitable means to the vehicle accelerator pedal mechanism whereby the operator could control at will movement of lever 180 to control the fuel rate of flow. Moving the metering valve 60 and consequently the helix 68 to the right or left from the position shown will cause the trailing edge of the helix to cover or uncover each of the spill ports 74 for a longer or shorter period of time during each revolution of the metering valve relative to the spill port. Accordingly, more or less fuel will be injected past the respective delivery valve 82 per pump revolution as a function of the axial position of the metering valve.

Figure 5:
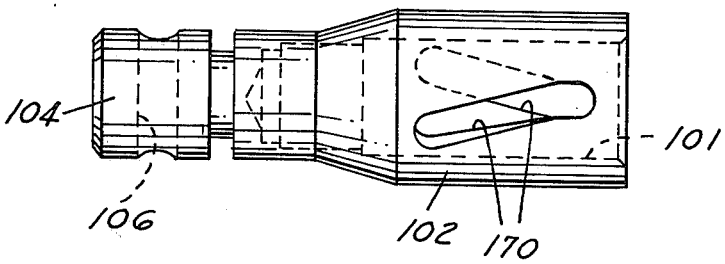
Figure 4:
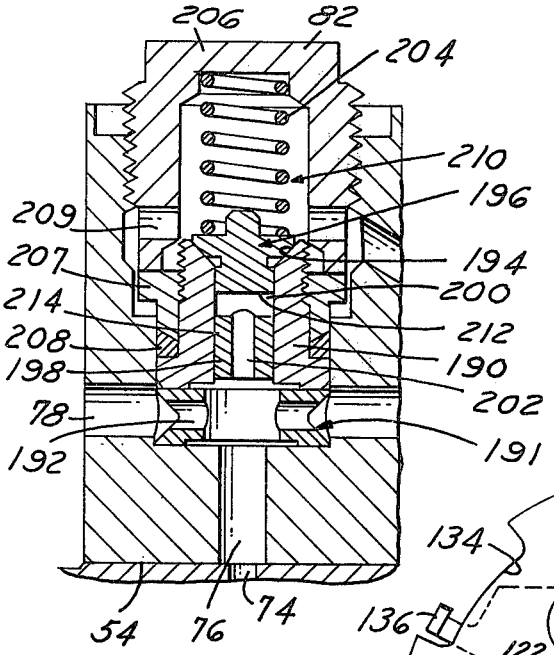

As seen more clearly in FIG. 5, each delivery valve 82 includes a stationary valve body portion 190 that seats on a spacer 191 located in the intersection of passages 76 and 78. The spacer has a pair of intersecting through bores 192 to provide communication between the passages and has an axial opening to flow fuel through and past the retraction valve. The body portion 190 has a conical seat 194 on its upper end. The latter cooperates with the spherical surface 195 of a retraction type delivery valve 196 that is slidably and sealingly mounted in a bore portion 198. The valve has a cross bore or hole 200 intersected by a supply passage 202 connected to the spacer passages. A spring 204 biases the retraction valve to its closed or seated position shown. The delivery valve has a cover portion 206 that is threaded to body portion 190 and compresses a spacer 207 against an annular seal 208. The cover is provided with a cross bore 209 that discharges into passage 84 (FIG. 1) leading to the injector nozzle for each combustion chamber.

When the helix 68 of the metering valve 60 rotates to cover a particular spill port 74, the pressure built up by the axial movement of pump plunger 46 to the right as seen in FIG. 1 causes the pressure acting against the bottom of the delivery valve to exceed the force of spring 204 and move the valve upwardly or open. Immediately upon the pressure in the cross hole 200 being exposed to the passage 210 upon passing the conical seat portion 194, the force of the fuel pressure will be applied against the increased exposed area of the spherical seat of the valve causing an immediate increase in pressure in chamber 210 and injection of the fuel past the nozzle, not shown.

When the metering sleeve valve helix 68 moves away from the spill port 74, and the plunger 46 begins to retract towards the left as seen in FIG. 1, the fuel in chamber 210 is drawn back into the pump plunger cavity 80 through the cross hole 200 and through the spill port 74 until the force of spring 204 in the delivery valve is sufficient to move the delivery valve 196 downwardly. As soon as the upper edge 212 of the cross hole 200 enters the bore 214 defined by the valve seat body 190, further drain of fuel into either line 76 or 78 is stopped. However, the retraction valve 196 will continue to move downwardly until the spherical valve seat engages the conical seat 194. This further movement withdraws part of the mass of the valve from the chamber 210 and thus decreases the effective pressure in chamber 210 to prevent afterdribbling or secondary injection into the combustion chamber.

The pump assembly is lubricated by a flow of oil through an inlet 220 (FIG. 1) connected to a diagonal passage 222. The latter leads to an annulus 224 surrounding the journal bearing surface on the stationary housing portion 18 within which rotates the sleeve of pumping member 34. The oil can leak leftwardly as seen in FIG. 1 to lubricate the pump cam face surfaces 44 engaging the pump plungers 46 and other adjacent surfaces and will fill the cavity 42 within the timing advance housing 20. Rightward flow of oil towards the metering sleeve valve 60 is prevented by an annular carbon seal 226 biased by a spring 228 against the face end of the extension of pumping member 34. The carbon seal also prevents leakage of the fuel towards the pumping member. It does permit the leakage of fuel along the space between the stationary sleeve 58 and the rotating metering sleeve valve 60 leftwardly between the metering sleeve valve and sleeve extension 102 to vent to the hollow interiors of both. The fuel then is permitted to flow rightwardly as seen in FIG. 1 out through the hollow interior of the metering sleeve valve and into the sump 96 from which it flows through the outlet 98 back to the inlet of the fuel pump supply. Thus, it will be seen that because of the open end of the metering sleeve valve, no fluid pressure forces will build up against the end of the valve tending to cause it to move in one direction or the other or to resist movement by the actuating lever 180.

Completing the construction, a fuel pressure relief groove 230 is provided between the pump plunger bore and the internal bore of the stationary housing 18 to permit drainage of any fuel trapped between the lands of the pumping plunger past spring 226 to the space internal of the fuel metering sleeve valve.

The operation of the pump assembly is believed to be clear from the previous description and a consideration of the drawings. Therefore, a detailed description is believed to be unnecessary for an understanding of the invention, and only the fuel injection timing operation will be described. In brief, with the engine off, no vacuum will be present in the cold start retard vacuum tube 176, and the servo spring 156 will position the rod 158 and drive coupling 100 leftwardly from the position shown to move pin 172 axially in slot 170. This will rotate the sleeve extension 102, drive pin 106, and cam plate 118 to the fuel injection timing retard position.

At the same time, the engine off position of lever 180 causes the metering sleeve valve 60 to be located as far leftwardly in FIG. 1 as possible so that the minimum desired portion, if any, of the metering sleeve valve helix 68 would be opposite any particular spill port 74. This allows a minimum flow of fuel to the injector nozzles upon engine start up. Depending upon the operation, complete fuel shut off could occur if the sleeve valve 60 were moved leftwardly to a position where the helix 68 does not cover any spill port during one revolution. Conversely, for a cold start where a rich mixture is required, the helix 68 may be positioned rightwardly so that the largest portion of the helix covers a spill port during any one revolution of the pumping member. It will be clear that the helix position will be such as to satisfy the engine fuel requirements under all operating conditions, such as is fully described in my patent, U.S. Pat. No. 3,319,568.

It will be noted that the movement of the helix and metering sleeve valve is entirely independent of the other components of the system since the sleeve valve is mounted so that its mass is movable per se without causing a corresponding movement of the centrifugal advance mechanism, for example. This permits movement of the manual lever 180 with low actuating forces and thus enables the metering sleeve valve to be designed with a smaller diameter, and the pump components as a whole to be of smaller mass.

Assume now that the engine has been started and reaches operating temperature. At this point, the vacuum control valve, not shown, opens to admit vacuum to the cold start retard servo vacuum line 176 causing the diaphragm 144 to move rightwardly. This permits the return spring 164 in coupling member 102 to axially move the drive coupling pin 172 rightwardly which rotates the sleeve extension 102 and drive pin 106 and centrifugal advance cam plate 118 in a clockwise direction to return the helix to the normal advance or null positions, as the case may be. That is, the helix will be rotated 30° in an advance direction to return it to the rotative position it attains without operation of the servo 95. Hereafter, advance of the fuel injection timing will be exclusively controlled by the centrifugal advance mechanism and in particular by the movement of the weights 130 in response to increases in engine speed, i.e., the speed of the pumping member 34. Accordingly, a progressive angular rotation in a fuel injection timing advance direction will occur as the engine speed increases causing an earlier injection of fuel into the combustion chambers.

The fuel flow rate will be varied as a function of the movement of the manually operated lever 180 in response to demand by the vehicle operator. More particularly, as the vehicle accelerator pedal is depressed, lever 180 will be rotated in a counterclockwise direction to move the metering sleeve valve 60 and helix portion 68 rightwardly as seen in FIG. 1 to progressively cover the spill ports 74 more and more for each revolution of the helix 68 and thus provide a greater volume of fuel injected to each of the combustion chambers.

From the foregoing, it will be seen that the invention provides a compact fuel injection pump assembly that is relatively simple in construction and easy to assemble and disassemble and permits an adjustment of the fuel flow rate merely by moving the metering sleeve valve alone without the necessity of also moving the entire mass of the centrifugal fuel injection advance mechanism, as is common in many known prior art fuel injection pump assemblies. It will also be seen that the construction is such that fuel buildup against the ends of the metering sleeve valve is prevented so as to minimize resistance to movement of the fuel flow rate control lever so that only small operating forces need be provided to move the lever at will.

While the invention has been shown and described in its preferred embodiment, it will be clear to those skilled in the arts to which the invention pertains that many changes and modifications may be made thereto without departing from the scope of the invention.

I claim:

1. A fuel injection pump of the spill port, plunger type including an engine speed responsive fuel pumping member effecting the axial reciprocation of a fuel pumping plunger, a fuel chamber having a fuel inlet and a spill port type fuel outlet, a fuel passage connecting the outlet in parallel flow relationship to one end of the plunger and to a pressure operable fuel delivery valve, a spool type fuel metering sleeve valve rotatably mounted in the chamber having a land formed in the shape of a helix cooperating with the spill port to at times during rotation of the helix block the spill port and at other times uncover the spill port to schedule the timing and duration of pressure buildup in the fuel passages, drive means including speed responsive fuel injection timing advance means interconnecting the sleeve valve and the pumping member for concurrent rotation while permitting limited angular rotation of the sleeve valve and helix relative to the pumping member in response to increases in speed of the pumping member to automatically advance the fuel injection timing, and separate means operable at will to retard the fuel injection timing schedule irrespective of the position of the injection timing advance means.

2. A fuel injection pump of the spill port, plunger type including an engine speed responsive fuel pumping member effecting the axial reciprocation of a fuel pumping plunger, a fuel chamber having a fuel inlet and a spill port type fuel outlet, a fuel passage connecting the outlet in parallel flow relationship to one end of the plunger and to a pressure operable fuel delivery valve, a spool type fuel metering sleeve valve rotatably mounted in the chamber, the sleeve valve having a land formed as a helix at times during rotation of the helix blocking the spill port and at other times uncovering the spill port for varying durations of time as a function of the rotative position of the valve and helix to determine the timing and duration of pressure buildup in the fuel passages, drive means including speed responsive fuel injection timing advance means interconnecting the sleeve valve and the pumping member for concurrent rotation while permitting a limited angular rotation of the sleeve valve in one direction relative to the pumping member from an initial position to fuel injection advanced timing positions in response to increases in speed of the pumping member above a predetermined level to automatically and progressively advance the fuel injection timing as a function of engine speed changes, and further means interconnecting the speed responsive means and the metering valve and operable at will to rotate the speed responsive means relative to the metering valve in an opposite direction to retard the fuel injection timing schedule irrespective of the position of the metering valve.

3. A pump as in claim 2, the further means including a pin and elongated angled slot connection whereby axial movement of one of the members of the connection effects an angular rotation of the other member of the connection.

4. A pump as in claim 2, including fluid pressure controlled servo means connected to the further means controlling the second rotation of the speed responsive means.

5. A pump as in claim 2, including temperature responsive means operable connected to the further means and responsive to the attainment of a predetermined temperature for rotating the speed responsive means relative to the metering valve.

6. A pump as in claim 2, the drive means including a connector axially slidably connected to the metering valve and rotatably fixed to the speed responsive means, a first pin and elongated slot connection between the connector and the pumping member providing rotation of the connector and speed responsive means by the pumping member while permitting an angular rotation of the connector by the speed responsive means relative to the pumping member, the further means including a second pin and elongated angled slot connection between the metering valve and connector permitting an angular rotation of the speed responsive means relative to the metering valve.

7. A pump as in claim 6, including servo means operable to move the connector axially to rotate the speed responsive means to retard the timing schedule.

8. A pump as in claim 7, the servo means including piston means axially movably connected to the connector, a source of vacuum connected to the piston for moving the piston in one direction, spring means biasing the piston in the opposite direction, movement of the piston rotatingthe connector and speed responsive means to retard the injection timing.

9. A pump as in claim 8, including actuator means between the piston and metering valve and extending coaxially through the metering valve.

10. A fuel injection pump of the spill port, plunger type including an engine speed responsive fuel pumping member effecting the axial reciprocation of a fuel pumping plunger, a fuel chamber having a fuel inlet and a spill port type fuel outlet, a fuel passage connecting the outlet in parallel flow relationship to one end of the plunger and to a pressure operable fuel delivery valve, a spool type fuel metering sleeve valve rotatably mounted in the chamber, the sleeve valve having a land formed in the shape of a helix for at times during rotation of the helix blocking the spill port and at other times uncovering the spill port for durations varying as a function of the rotative position of the valve and helix to schedule the timing and duration of pressure buildup in the fuel passages, drive means including speed responsive means interconnecting the sleeve valve and the pumping member for concurrent rotation while permitting a limited angular rotation of the sleeve valve and helix in one direction relative to the pumping member within a first range in response to increases in speed o the pumping member above a predetermined level to automatically advance the fuel injection timing, and further means interconnecting the pumping member and metering valve and speed responsive means and operable at will to provide a limited angular rotation of the speed responsive means in the opposite direction relative to the metering valve within a second range to retard the fuel injection timing schedule without varying the angular position of the metering valve.

11. A fuel injection pump of the spill port, plunger type including an engine speed responsive fuel pumping member effecting the axial reciprocating of a fuel pumping plunger, a fuel chamber having a fuel inlet and a spill port type fuel outlet, a fuel passage connecting the outlet in parallel flow relationship to one end of the plunger and to a pressure operable fuel delivery valve, a spool type fuel metering sleeve valve axially aligned with the pumping member and rotatably mounted in the chamber and having a land formed as a helix cooperating with the spill port to at times during rotation of the helix block the spill port and at other times uncover the spill port to schedule the timing and duration of pressure buildup in the fuel passages, drive means interconnecting the metering valve and pumping member including a drive shaft axially slidably connected to the metering valve and to a coupling member rotatably mounted within the pumping member, a pin and slot type connection between the coupling and pumping member providing concurrent rotation while permitting a limited angular relative movement therebetween, a speed responsive fuel injection timing advance member fixed to the coupling member and driven by the pumping member and responsive to increases in speed of the pumping member for rotating the coupling member relative to the pumping member to advance the fuel injection timing, and a second pin and slot connection between the drive shaft and coupling member permitting at will a second angular relative movement of the coupling member and speed responsive means relative to the metering valve to retard the fuel injection timing.

12. A pump as in claim 1, including temperature responsive means operable at times to move the drive shaft axially.

13. A pump as in claim 12, the drive shaft extending axially through the metering valve, and engine vacuum controlled servo means operably engagable with the drive shaft to axially move the drive shaft to retard the injection timing schedule.

14. A pump as in claim 11, the second connection including an elongated angled slot in the coupling member receiving a pin fixed to the drive shaft whereby axial movement of the drive shaft relative to the metering valve and coupling member rotate the coupling member and speed responsive member to retard the timing.

15. A pump as in claim 14, including vacuum controlled servo means operable at times to move the drive shaft axially.

* * * * *